United States Patent [19]

Hubbard et al.

[11] Patent Number: 5,008,961

[45] Date of Patent: Apr. 23, 1991

[54] SANITARY HEAD COVERING AND METHOD OF MANUFACTURE

[75] Inventors: Vance M. Hubbard; Welton K. Brunson, both of Bedford, Tex.

[73] Assignee: Tecnol, Inc., N. Richland Hills, Tex.

[21] Appl. No.: 382,259

[22] Filed: Jul. 20, 1989

[51] Int. Cl.[5] ..... A42B 1/02; A42B 1/04

[52] U.S. Cl. ..... 2/195; 2/197

[58] Field of Search ..... 2/195, 192, 197, 200

[56] References Cited

U.S. PATENT DOCUMENTS

| | | | |
|---|---|---|---|
| 2,748,396 | 6/1956 | Lipschutz et al. | 2/195 |
| 3,082,430 | 3/1963 | Wagenfeld | 2/197 |
| 3,383,709 | 5/1968 | Bauer | 2/197 |
| 3,390,405 | 7/1968 | Gruber | 2/197 |
| 3,394,409 | 7/1968 | Wagenfeld | 2/195 |
| 3,564,612 | 2/1971 | Wagenfeld | 2/197 |
| 4,055,857 | 11/1977 | Brucciani | 2/197 |
| 4,186,446 | 2/1980 | Maney | 2/197 |
| 4,244,058 | 1/1981 | Randall | 2/197 |
| 4,453,276 | 6/1984 | Smith et al. | 2/195 |
| 4,468,818 | 9/1984 | Flannery | 2/195 X |
| 4,651,352 | 3/1987 | Ranzer | 2/197 |
| 4,660,224 | 4/1987 | Ashcraft | 2/48 |
| 4,719,651 | 1/1988 | Tereshinski | 2/197 |

FOREIGN PATENT DOCUMENTS

| | | | |
|---|---|---|---|
| 160088 | 12/1954 | Australia | 2/195 |

*Primary Examiner*—William A. Cuchlinski, Jr.
*Assistant Examiner*—Joseph A. Rhoa
*Attorney, Agent, or Firm*—Baker & Botts

[57] ABSTRACT

An improved head covering (10) comprising an elongated sheet (12) folded in half about a transverse axis (14) to form sides (16 and 18). An expandable crown portion (20) is adhered to the sides (16 and 18) along upper portions (15) and to itself along band (21). A tie strip (22) is attached to the sides (16 and 18) for securing the improved head covering (10) to the head of a wearer.

11 Claims, 3 Drawing Sheets

SANITARY HEAD COVERING AND METHOD OF MANUFACTURE

TECHNICAL FIELD OF THE INVENTION

This invention relates in general to head coverings, and in particular to an improved sanitary head covering and method of manufacture.

BACKGROUND OF THE INVENTION

Sanitary hats are worn by many different types of workers in many different types of occupations. Some examples include: laboratory technicians, surgical personnel, and cooks. It is necessary for these people to wear a sanitary head covering to prevent material such as hair, dandruff and dirt from falling from their hair or head onto their work, be it a test sample, a patient or food. It has long been a practice to make these head coverings from a cheap disposable material such as paper.

The typical disposable head coverings have heretofore been manufactured utilizing manual cutting and sewing operations. A manufacturing process, such as has been utilized in the past, can require as many as nine different start and stop cutting steps and a plurality of different sewing steps. A process utilizing so many labor intensive manual steps is not only time consuming, but expensive. Thus, there is a need for a method of manufacturing an improved sanitary head covering by a less expensive manufacturing process.

SUMMARY OF THE INVENTION

The present invention disclosed herein comprises an improved sanitary head covering and method of manufacture which substantially eliminates or reduces problems associated with prior head coverings and methods of manufacture.

In accordance with one aspect of the present invention, a sanitary head covering is provided. The sanitary head covering has an elongated sheet which forms a left and a right side. An expandable crown portion is attached to the left and to the right sides of the elongated sheet. The head covering is secured to the head of the wearer by a securing portion.

In another aspect of the present invention, the elongated sheet comprises an absorbent material that is folded in half along a transverse axis. The folding forms a closed front end and an open rear end. The expandable crown portion comprises woven or nonwoven material which is attached to the left and right sides of the head covering. The crown portion may be attached to the sides by gluing or heat sealing. A tie strip is added to the bottom edge of the left and right side portions to make a tie strip for securing the head covering to the head of a wearer.

BRIEF DESCRIPTION OF THE DRAWINGS

For a more complete understanding of the present invention, and for further advantages thereof, reference is now made to the following Detailed Description taken in conjunction with the accompanying Drawings in which.

DETAILED DESCRIPTION OF THE INVENTION

Figures 1A, 1B, 1C, 2:
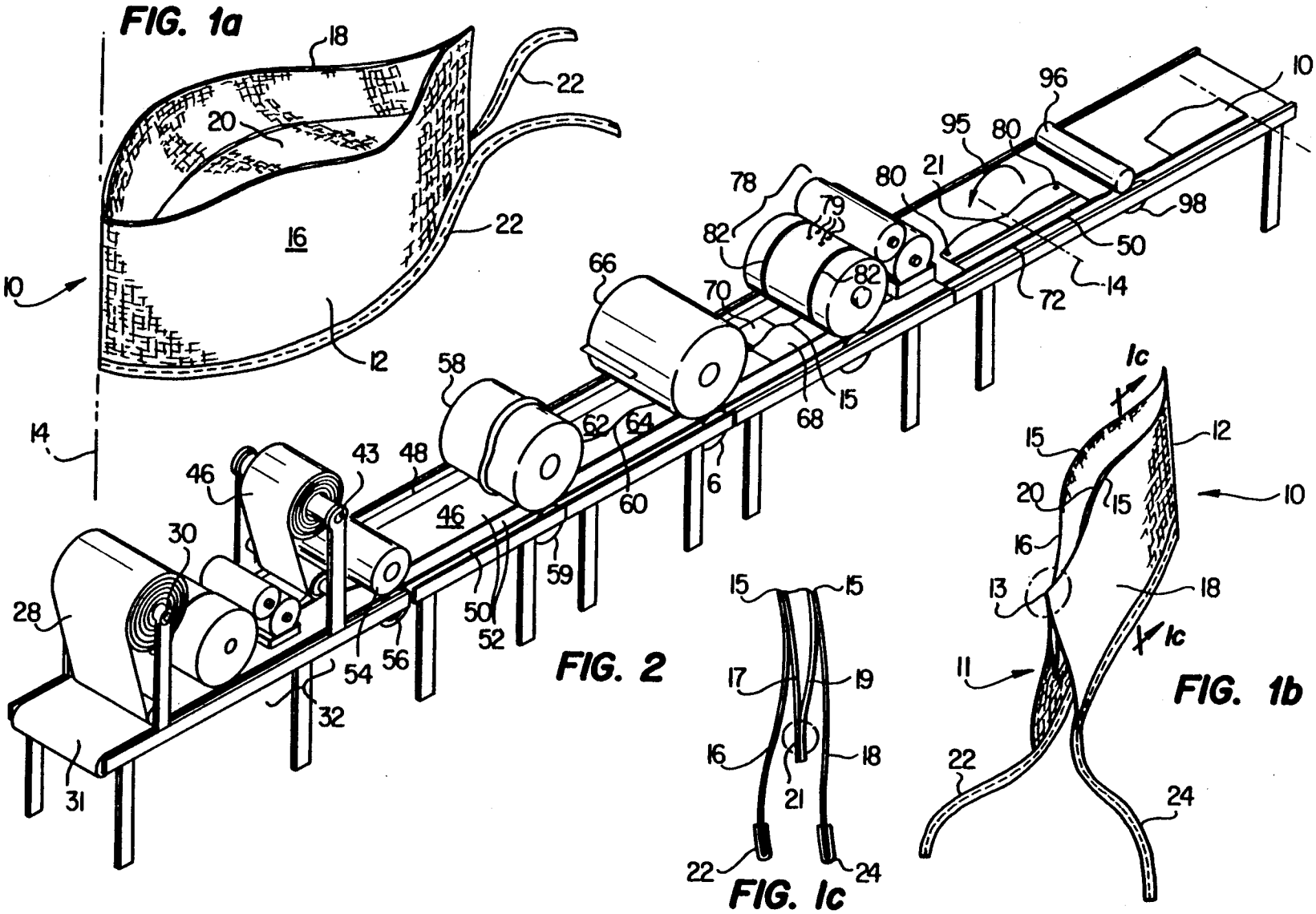
FIG. 1*a* is a perspective view of a head covering in accordance with the preferred embodiment of the present invention.
FIG. 1*b* is a rear perspective view of the head covering of FIG. 1*a;*
FIG. 1*c* is a cross-sectional view of the head covering of FIG. 1*b* taken along line 1*c*—1*c*.
FIG. 2 is a perspective view of the apparatus used to manufacture the head covering of the present invention.

In FIGS. 1—8, like items are identified by like and corresponding numerals for ease of reference. Referring to FIG. 1*a*, an improved sanitary head covering in accordance with the preferred embodiment of the present invention is generally identified by reference numeral 10. The head covering comprises an elongated sheet 12 folded about a transverse axis indicated by line 14 to form identical first and second sides 16 and 18. The elongated sheet 12 may comprise an absorbable cellulose fiber stock.

Sealed to the elongated sheet 12 is an expandable crown portion 20. The crown portion 20 comprises, for example, a woven or nonwoven material. The crown portion 20 is sealed to the sides 16 and 18 by any appropriate method such as gluing or heat sealing. Attached to the bottom edge of the head covering 10 is a tie strip 22. To place the head covering 10 on the head of the wearer, the head covering 10 is grasped along the bottom edges where the tie strip 22 is attached, and the first and second sides 16 and 18 are separated. The head covering 10 is placed over the head which causes the expandable crown portion 20 to open. The head covering 10 is then secured in place on the head of the wearer by tying the tie strip 22 behind the head.

FIG. 1*b* shows the head covering 10 in a rear perspective view. From this view it can be seen that the rear 11 of head covering 10 is open except for top rear corner 13. The head covering 10 has a top edge 15 shaped similar to a sinusoidal curve. This shape provides for improved fit on the head of the wearer as it, in conjunction with the crown portion 20, conforms to the general shape of the top of a head.

FIG. 1*c* shows an end cross-sectional view along line 1*c*—1*c* of the head covering 10 of FIG. 1*b*. The sides 16 and 18 are sealed to the expandable crown portion 20 from the top edge 15 to a specified distance from the top edge 15. The specified distance, for example, one inch, is equally distant from the top edge 15 all along the sinusoidal shaped curve of top edge 15. The crown portion 20 is comprised of a first section 17 and a second section 19. It is an important aspect of the invention that first section 17 is sealed to first side 16 and second section 19 is sealed to second side 18 while first and second sections 17 and 19 are sealed to each other at band 21 spaced apart from the top edge 15. Thus, the band 21, in conjunction with the seals along the top edge 15, allows the crown portion 20 to be expandable and allows high-speed automated manufacture of head covering 10.

FIG. 2 illustrates an apparatus for manufacturing the improved head covering 10. A roll of absorbent material 28 is placed on an unwind stand 30. The absorbent material 28 comprises an absorbable cellulose fiber stock such as is available from Scott Paper Co. under the name of High-Loft.

The absorbent material 28 is fed by any appropriate means, such as conveyor belt 31, past a first gluing station 32. The first gluing station 32 applies glue, for example, hot melt glue, to material 28.

A roll of crown material 46 is then unwound from unwind stand 43. Crown material 46 has less width than material 28 and is placed on top of the absorbent material 28 evenly and centrally spaced between edges 48 and 50. A combined sheet 52, comprised of absorbent material 28 and crown material 46, is passed through nip rollers 54 and 56 to firmly press the crown material 46 and the absorbent material 28 together.

The combined sheet 52 is then passed between a cutter 58 and an anvil roll 59 which cuts a serpentine (or sinusoidal) pattern 60 to separate the combined sheet 52 into a first section 62 and a second section 64. The cutter 58 may be substituted by any other appropriate device, for example, a rotary die cutter or a laser.

The first and second sections 62 and 64 are then passed between a chopper roll 66 and an anvil roll 67 to separate the sections 62 and 64 into a pair of oppositely facing hat forms 68 and 70. The hat forms 68 and 70 have top edges 15 generally resembling a sinusoidal curve. The chopper roll 66 is designed to cut sections 62 and 64 in a staggered fashion to make hat forms 68 and 70.

One of the hat forms, for example, form 68, is advanced ahead of form 70 by a device, not shown. Both hat forms 68 and 70 (only hat form 68 is hereinafter shown for the sake of simplicity) have a tie strip 22 applied to the bottom edge 50 and attached in place, for example, by a sewing machine, not shown. Tie strip 22 may comprise, for example, a nonwoven polyesther or elastic. The tie strip 22 is then cut to the proper length by any appropriate method such as a chopper and anvil roll, not shown.

The hat form 68 then proceeds to a second gluing station 78 which uses glue points 79 and glue strip 82 to form dots 80 and band 21 proximate the bottom edge 84 of the crown material 46. The glue used to apply dots 80 and band 21 may be, for example, a hot melt or a coadhesive (a coadhesive is defined herein as an adhesive that will stick to itself only).

The hat form 68 is then folded in half about transverse axis 14 by a device, not shown, as illustrated by arrow 95. Hat form 68 is then pressed together by rollers 96 and 98 to form the head covering 10. The glue band 21 may if necessary be reactivated such as by heat and serves to glue the crown material 46 together to form the expandable crown portion 20. The head covering 10 thus formed is comfortable, fits any head size and is both economically and efficiently made with virtually no wasted materials. The head covering 10 may be removed from conveyor 31 by any appropriate method and packaged for sale.

Figure 3A:
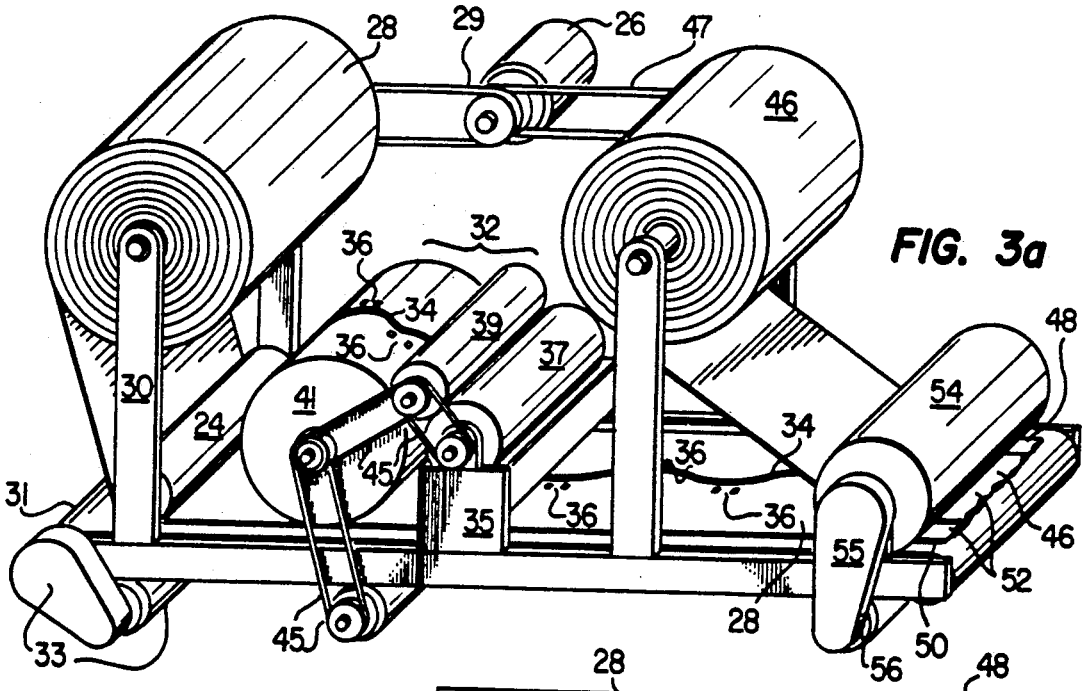
FIG. 3*a* is a perspective view of a portion of the apparatus of FIG. 2.

Referring now to FIG. 3*a*, the apparatus of FIG. 2 is shown in more detail up through the nip rollers 54 and 56. The roll of absorbent material 28 is pulled from unwind stand 30 which may be driven by any appropriate method such as drive motor 26 and belt 29. The absorbent material 28 may be fed by the conveyor belt 31 under roller 24, although it is to be understood that conveyor belt 31 is not required. Conveyor belt 31 may be driven by any appropriate drive arrangement 33.

The conveyor belt 31 carries the absorbent material 28 past the first gluing station 32. The gluing station 32 may comprise, for example, a glue pan 35, a pick-up roll 37, a metering roll 39 and an application roll 41 as is well known in the art. The first gluing station 32 may be driven by powered roller and associated belts 45. Station 32 applies glue in a serpentine pattern 34 to material 28 and places sets of glue dots 36 along the sides of serpentine pattern 34.

Crown material 46 is then unwound from unwind stand 43 which may be powered by belt 47 from motor 26. At this time, if desired, crown material 46 may have holes cut or punched therein by an appropriate device, not shown, corresponding to the location of top rear corner 13 (FIG. 1*b*), as will be subsequently described in more detail. Crown material 46 is placed evenly and centrally between edges 48 and 50 of the absorbent material 28 to form a combined sheet 52. The combined sheet 52 is then passed between nip rollers 54 and 56. Nip rollers 54 and 56 press the combined sheet 52 together along the serpentine pattern 34 and glue dots 36. Nip rollers 54 and 56 may be driven, for example, by a powered assembly 55.

Figure 3B:
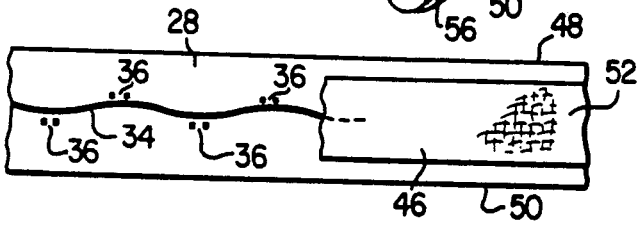
FIG. 3*b* is a plan view of the product resulting from the apparatus of FIG. 3*a;*

FIG. 3*b* illustrates a plan view of the product of the apparatus shown in FIG. 3*a*. The absorbent material 28 has a serpentine (or sinusoidal) pattern 34 placed along its central axis. It is an important aspect of the present invention that sets of glue dots 36 are spaced along the pattern 34 to provide extra stiffness to top front and rear corners of the head covering 10. The crown material 46 is placed over the absorbent material 28 spaced evenly between the edges 48 and 50. The combined sheet 52, which is glued along the pattern 34 and the glue dots 36, is passed to the next apparatus.

Figure 4A:
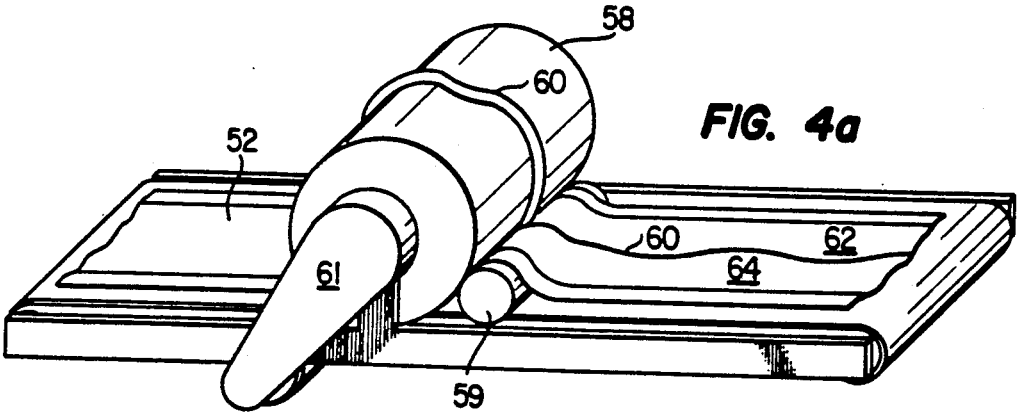
FIG. 4*a* is a perspective view of a serpentine cutter of the apparatus of FIG. 2.

FIG. 4*a* shows a perspective view of the cutter 58 and an anvil roll 59. The combined sheet 52 is passed between the cutter 58 and the anvil roll 59 to cut the sheet 52 along a serpentine (or sinusoidal) pattern 60 (slitting through the middle of the serpentine glue pattern 34). The combined sheet is thus separated into a first section 62 and a second section 64. The cutter 58 and anvil 59 may be driven, for example, by a drive assembly 61.

Figure 4B:
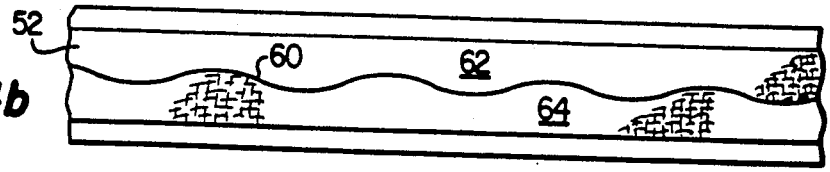
FIG. 4*b* is a plan view of the product resulting from the cutter of FIG. 4*a;*

FIG. 4*b* shows a plan view of the product of the apparatus in FIG. 4*a*. The combined sheet 52 is cut along a serpentine pattern 60 coinciding with the middle of the serpentine glue pattern 34. The combined sheet 52 is thus separated longitudinally into first and second sections 62 and 64.

Figure 5A:
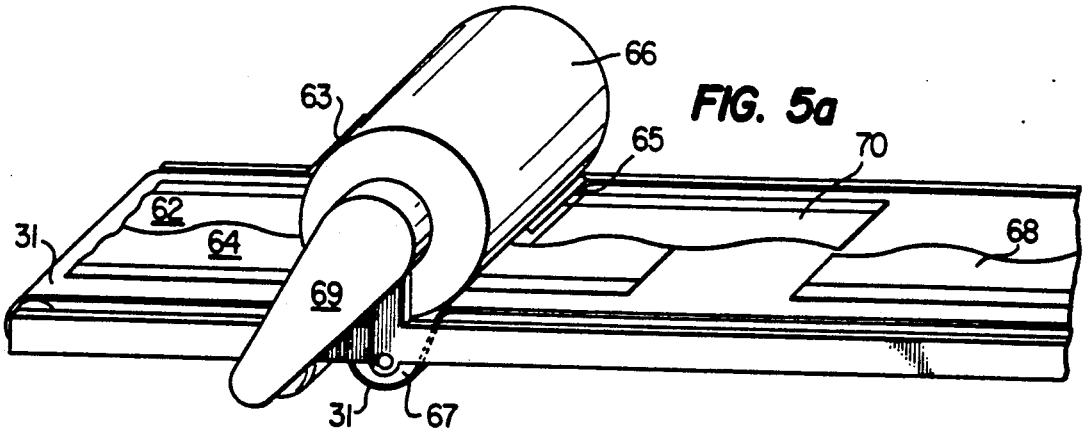
FIG. 5*a* is a perspective view of the hat form cutter of the apparatus of FIG. 2.

As shown in FIG. 5*a*, the first and second sections 62 and 64 are passed between a chopper roll 66 and an anvil roll 67. The chopper roll 66 has chopping blades 63 and 65 which cut the first and second sections 62 and 64 into pairs of oppositely facing hat forms 68 and 70. Chopper roll 66 may be driven, for example, by a drive assembly 69. Conveyor belt 31 can be seen to pass around anvil roll 67 while sections 62 and 64 pass between rolls 66 and 67.

Figure 5B:
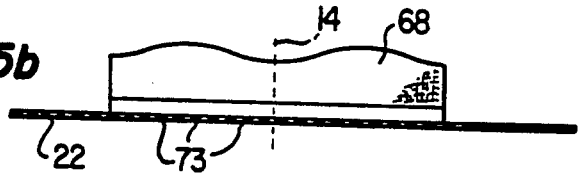
FIG. 5*b* is a plan view of the product resulting from the cutter of FIG. 5*a;*

FIG. 5*b* shows the product of the apparatus of FIG. 5*a*. Oppositely facing hat forms 68 and 70 (only hat form 68 is hereinafter shown for the sake of simplicity) are formed by the chopper and anvil rolls 66 and 67. The transverse axis 14 is shown in FIG. 5*b* to illustrate the front folding edge of each hat form 68 and 70.

Although not shown, one of the hat forms, for example form 68, is advanced ahead of form 70 by a device, not shown. Both hat forms 68 and 70 have the tie strip 22 attached to the bottom edge 50, for example, by a sewing machine, not shown, as is well known in the art, to form stitches 73. The tie strip 22 is cut to the proper length by a chopper and anvil roll, not shown.

FIG. 5*b* shows the product as a result of the apparatus shown in FIG. 5*a*. Hat form 68 is shown with tie strip 22 and stitches 73. Transverse axis 14 illustrates the front edge about which hat form 68 is to be folded as will be subsequently described in more detail.

Figure 6A:
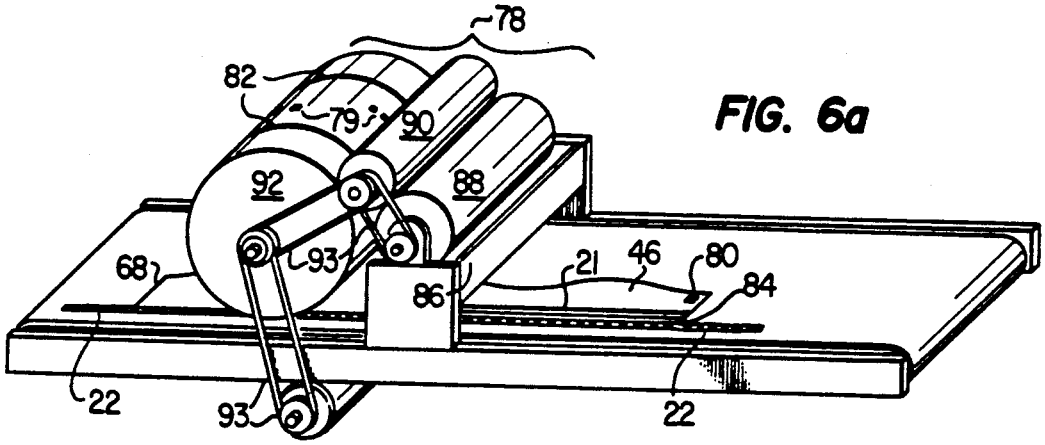
FIG. 6*a* is a perspective view of the crown gluing section of the apparatus of FIG. 2.

The hat form 68 then proceeds to a second gluing station 78 as illustrated in FIG. 6*a*. Gluing station 78 applies the glue dots 80 and a glue band 21 proximate the bottom edge 84 of the crown material 46. Second gluing station 78 may comprise, for example, a glue pan 86, a pick-up roll 88, a metering roll 90 and an application roll 92. Glue station 78 may be driven, for example, by a driven roller and associated belts 93.

Figure 6B:
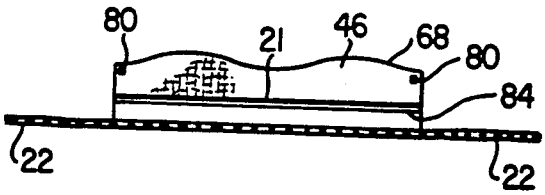
FIG. 6*b* is a plan view of the product resulting from the gluing section of FIG. 6*a;*
Figure 7:
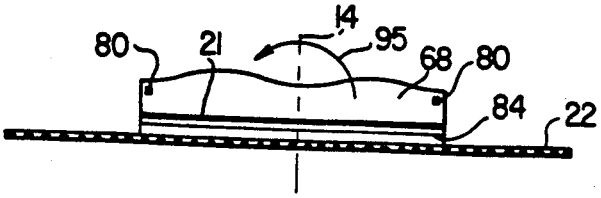
FIG. 7 is a plan view of a hat form prior to being folded in half.

FIG. 6*b* illustrates the product resulting from the apparatus of FIG. 6*a*. Hat form 68 has a glue band 21 along its entire length proximate the bottom edge 84 of the crown material 46. A glue dot 80 is positioned in each upper corner of the crown material 46 or if holes have been punched in crown material 46, as previously discussed, glue dots 80 are positioned on each upper corner of absorbent material 28. Glue dots 80 seal the top rear corner 13 of the head covering 10 throughout all layers of corner 13. If holes are not punched in crown material 46, the glue dots 80 may be "blown through" with ultrasonics or heat to form the seal. The hat form 68 is then folded in half by a device not shown, about transverse axis 14 as indicated by arrow 95 in FIG. 7.

Figure 8:
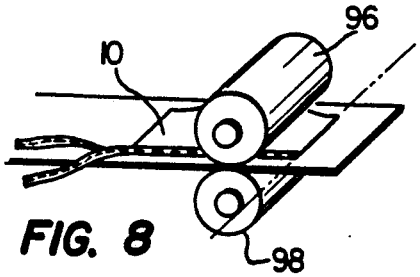
FIG. 8 is a perspective view of the final folding of the hat form in accordance with the preferred embodiment of the present invention.

FIG. 8 illustrates the final apparatus used to complete the hat form 10. A pair of nip rollers 96 and 98 are used to press head covering 10 together after it has been folded in half about transverse axis 14. This causes glue band 21 to come in contact with itself and, therefore, stick together. At the same time, glue dots 80 are stuck together. It may be necessary to reactivate the glue in glue band 21 and glue dots 80 by some method such as ultrasonics or heat.

Although not shown, it is to be understood that other methods of securing the head covering portions to each other may be employed. For example, instead of glue pattern 34 and glue band 21, heat sealing or ultrasonic techniques may be applied. Also, it is to be understood that an appropriate power source, such as electricity, is to be provided and that all driven equipment is appropriately timed, supported by frames and covered with guards for safety.

Although the present invention has been described with respect to a specific preferred embodiment thereof, various changes and modifications may be suggested to one skilled in the art, and it is intended that the present invention encompass such changes and modifications as fall within the scope of the appended claims.

What is claimed is:

1. A method for forming a sanitary head covering, comprising the steps of:

adhering a first upper edge of an expandable crown portion to a second upper edge of an elongated flexible sheet;

securing ties to said elongated sheet to enable attachment of the head covering to the head of a wearer;

folding said elongated sheet and said crown portion in half about a transverse axis to form a first and a second side portion;

adhering a first lower edge of said crown portion of said first side portion to a second lower edge of said crown portion of said second side portion; and adhering a first corner on said upper edge of said elongated sheet which is opposite said transverse axis on said first side portion to a second corner on said upper edge of said elongated sheet which is opposite said transverse axis on said second side portion to form the headcovering.

2. The method of claim 1, wherein said elongated sheet is formed by:

unwinding a length of sheet material;

cutting said sheet material in a serpentine pattern substantially around a central axis to form facing portions, said serpentine pattern forming said upper edges; and cutting said facing portions along transverse axis to form said elongated sheets.

3. The method of claim 2, wherein the step of cutting a serpentine pattern comprises rotary die cutting.

4. The method of claim 2, wherein the step of cutting a serpentine pattern comprises laser cutting.

5. The method of claim 2, wherein the step of adhering an expandable crown portion comprises:

applying a serpentine glue pattern to said length of sheet material corresponding to said serpentine cut pattern;

pressing a crown material onto said serpentine glue pattern prior to said step of serpentine cutting; and applying a glue band distal said serpentine glue pattern to said crown material prior to said step of folding.

6. The method of claim 1, wherein the step of adhering a crown portion to said sheet comprises heat sealing said crown portion to said sheet.

7. The method of claim 1, wherein the step of securing ties comprises sewing tie strips to edges of said elongated sheet distal said upper edge.

8. A method for forming a sanitary head covering, comprising the steps of:

positioning an elongated crown material over an elongated sheet material;

fixing portions of said crown material to said sheet material;

sinuously cutting said crown material and said sheet material about a central axis and transverse axes into hat forms wherein the central axis is central to both the crown material and the sheet material;

securing each of said hat forms together by said crown material to form the head covering and wherein the width of the elongated crown material is less than the width of the elongated sheet material.

9. The method of claim 8, wherein the step positioning comprises:

unwinding said sheet material; and unwinding said crown material evenly and centrally onto said sheet material.

10. The method of claim 8, wherein the step of securing comprises:

applying a glue band to said crown material distal said central axis on each said hat form; and folding each said hat form in half about a transverse axis along said glue band to secure said hat form together.

11. The method of claim 8, further including attaching tie strips to said hat forms for securing the head covering to a wearer's head.

* * * * *